US011542776B2

(12) United States Patent
Jandhyala et al.

(10) Patent No.: US 11,542,776 B2
(45) Date of Patent: Jan. 3, 2023

(54) METHOD TO PRODUCE A STABLE DOWNHOLE PLUG WITH MAGNETORHEOLOGICAL FLUID AND CEMENT

(71) Applicant: Halliburton Energy Services, Inc., Houston, TX (US)

(72) Inventors: Siva Rama Krishna Jandhyala, Pune (IN); Ganesh Shriniwas Pangu, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/052,023

(22) PCT Filed: Jun. 5, 2018

(86) PCT No.: PCT/US2018/035979

§ 371 (c)(1),
(2) Date: Oct. 30, 2020

(87) PCT Pub. No.: WO2019/236059

PCT Pub. Date: Dec. 12, 2019

(65) Prior Publication Data

US 2021/0238952 A1 Aug. 5, 2021

(51) Int. Cl.
*E21B 33/134* (2006.01)
*E21B 33/16* (2006.01)

(52) U.S. Cl.
CPC ..... *E21B 33/134* (2013.01); *E21B 33/16* (2013.01)

(58) Field of Classification Search
CPC ..... E21B 33/134; E21B 33/16; E21B 33/13; E21B 33/12; F15B 21/065; C09K 8/42; C09K 8/426
See application file for complete search history.

(56) References Cited

U.S. PATENT DOCUMENTS

| | | | |
|---|---|---|---|
| 6,787,058 | B2 | 9/2004 | Foister |
| 7,021,406 | B2 | 4/2006 | Zitha |
| 9,181,470 | B2 | 11/2015 | Nguyen |
| 2003/0019622 | A1 | 1/2003 | Goodson |

(Continued)

FOREIGN PATENT DOCUMENTS

| | | | |
|---|---|---|---|
| WO | 03042495 | A1 | 5/2003 |
| WO | 2016039719 | A1 | 3/2016 |

OTHER PUBLICATIONS

J.F. Heathman, Advances in Cement-Plug Procedures, Advances in Cement-Plug Procedures, J. Petroleum Tech., vol. 48, Issue 9, 1996, pp. 825-831, SPE 36351.

(Continued)

*Primary Examiner* — Daniel P Stephenson
(74) *Attorney, Agent, or Firm* — K&L Gates LLP

(57) ABSTRACT

Methods for producing a plug in a wellbore within a downhole environment are provided. The method includes introducing a magnetorheological fluid into the wellbore and exposing the magnetorheological fluid to a magnetic field to form a base plug within the wellbore. The base plug contains a viscoelastic solid derived from the magnetorheological fluid. The method also includes introducing a cement slurry into the wellbore and onto the base plug and forming a cement plug on the base plug from the cement slurry.

20 Claims, 2 Drawing Sheets

(56) References Cited

U.S. PATENT DOCUMENTS

| | | | | |
|---|---|---|---|---|
| 2011/0290506 | A1 | 12/2011 | Ocalan | |
| 2014/0262268 | A1 | 9/2014 | Kageler | |
| 2015/0184497 | A1 | 7/2015 | Whitby | |
| 2016/0010424 | A1 | 1/2016 | Van Oort | |
| 2017/0191341 | A1* | 7/2017 | Fripp | E21B 33/134 |
| 2019/0242208 | A1* | 8/2019 | Estrada-Giraldo | E21B 21/003 |
| 2020/0032614 | A1* | 1/2020 | Usher | E21B 33/134 |
| 2021/0238952 | A1* | 8/2021 | Jandhyala | E21B 33/16 |

OTHER PUBLICATIONS

Sukhwani, V. et al., Synthesis and Characterization of Low Cost Magnetorheological (MR) Fluids, Proceedings of SPIE, vol. 6526, 2007, pp. 65262R-1-65262R-12, SPIE 65262R.

V. Kancharla et. al., Synthesis and Characterization of Magnetorheological Fluids with Super Paramagnetic Nanomaterials in Polymeric Matrix, NSTI-Nanotech vol. 1, 2006, pp. 362-364.

International Search Report and Written Opinion dated Feb. 1, 2019 for PCT Application No. PCT/US2018/035979 filed Jun. 5, 2018 (15 pages).

* cited by examiner

METHOD TO PRODUCE A STABLE DOWNHOLE PLUG WITH MAGNETORHEOLOGICAL FLUID AND CEMENT

BACKGROUND

This section is intended to provide relevant background information to facilitate a better understanding of the various aspects of the described embodiments. Accordingly, it should be understood that these statements are to be read in this light and not as admissions of prior art.

Plugs are lowered into or formed in a subterranean wellbore to a desired location and then used to isolate pressure and restrict fluid flow between subterranean zones. Plugs can be made of various materials including gels, polymers, rubbers, muds, and concrete. The typical success rate in placing open hole concrete plugs is relatively low, such as two or more attempts before forming a successful plug. One of the principal reasons for a poor cement job is that the plug slumps after placement and during drying if the bottom of the plug is located in an open hole outside of the casing in the wellbore. This failure can occur because of a weak base or unexpected losses. The consequence is that the desired top of plug is not reached or there is too much contamination of the plug with the fluid below the plug.

If a plug has to be placed inside a tubular, mechanical supports can form a reliable plug base. These types of plugs are typically drillable, retrievable, or permanent plugs or packers. However, if the plug has to be placed in an open hole, the options are to use viscous muds or reactive formulations like chemical gels. Viscous muds may have high surface viscosities making it difficult to mix and pump. There is also a limit to how much high viscosities one can attain. Reactive formulations involve temperature or pH driven kinetics. In such cases, there is a risk of reaction occurring before the formulation reaches the desired depth. Also, the reaction kinetics can become altered and the gelling process is susceptible to failure. If there are any losses, both viscous muds and reactive formulations may not be able to provide a reliable plug.

Therefore, there is a need for a method producing a plug in a wellbore that overcomes these shortcomings of conventional plugs.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1A:
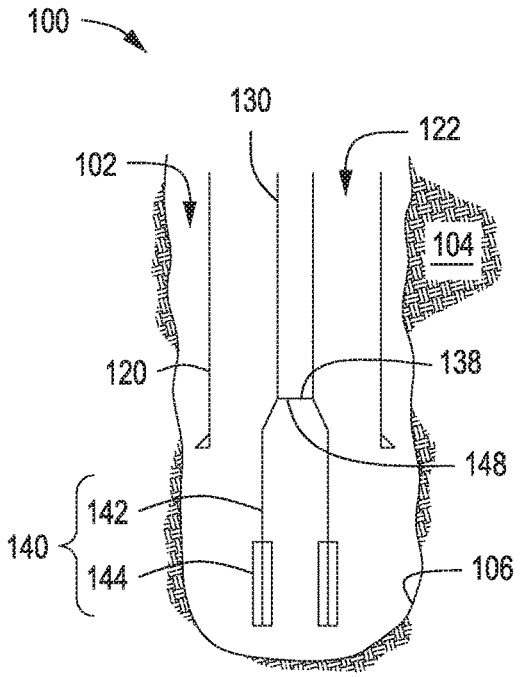
FIGS. 1A-1D are schematic views of a well system as a downhole plug is produced within a wellbore, according to one or more embodiments.

Embodiments provide methods for producing a plug in a wellbore within a downhole environment. FIGS. 1A-1D are schematic views of a well system 100 while a downhole plug is produced within a wellbore 102 by utilizing methods described and discussed herein, according to one or more embodiments. In FIG. 1A, the well system 100 is located in and around the wellbore 102 containing a casing 120 positioned within a surface 106 of the wellbore 102. The wellbore 102 and the casing 120 extend below ground, such as into a subterranean region 104 or other downhole environment.

A work string 130 coupled to a detachable tool 140 can be lowered into the casing 120 and the wellbore 102. The casing 120 and components thereof are non-magnetic, as such, do not hinder or otherwise interfere with the lowering of the detachable tool 140 into the wellbore 102. The work string 130 can be or can include, but is not limited to, one or more pipes (e.g., jointed pipe, hard wired pipe, or other deployment hardware), tubulars, coiled tubings, slicklines, wireline cables, tractors, a kelly, a bottom hole assembly (BHA), other conveyance devices, or any combination thereof.

The detachable tool 140 includes a support structure 142 containing one or more permanent magnets 144. Alternatively, other magnets, such as one or more electromagnets or one or more switchable magnetic assemblies may be used instead of the permanent magnet 144. The support structure 142 can include or be made with, but is not limited to, one or more materials including pipe, rod, bar, beam, plate, or any combination thereof. A lower surface 138 on the work string 130 is detachably coupled or connected to an upper surface 148 on the support structure 142 of the detachable tool 140.

The detachable tool 140 is introduced or otherwise placed into the wellbore 102. As depicted in FIG. 1A, the detachable tool 140 is positioned at a desired depth or location in the downhole end of the casing 120 via the work string 130. The permanent magnet 144 is typically placed into the wellbore 102 prior to introducing the magnetorheological fluid 152 but does not necessarily need to be. The permanent magnet 144 is positioned outside of the casing 120 and the support structure 142 is partially positioned inside and outside of the casing 120. The permanent magnet 144 is positioned to the desired depth or location where the base plug 150 is to be subsequently produced about the permanent magnet 144.

Figure 1B:
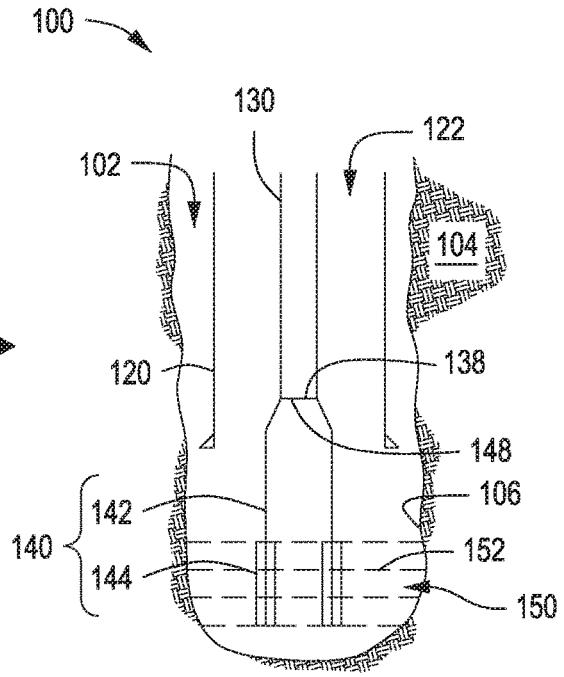

Magnetorheological (MR) fluid is introduced into the wellbore 102 by passing the MR fluid through the work string 130, an annulus 122 of the casing 120, or a combination of both. As depicted in FIG. 1B, the MR fluid 152 is exposed to a magnetic field generated by the permanent magnet 144 and forms a base plug 150 within the wellbore 102. The base plug 150 extends across the perimeter of the wellbore 122 against the surface 106. The base plug 150 contains a viscoelastic solid derived from the magnetorheological fluid 152. As used herein, the term "viscoelastic solid" means the magnetorheological fluid has undergone a magnetic field induced transformation such that the resulting composition is in a viscoelastic or gelled state. See for example, Rod Lakes (1998). Viscoelastic solids. CRC Press. ISBN 0-8493-9658-1. For example, the magnetorheological fluid 152 is introduced into the wellbore 102 having a first viscosity. The term "viscosity" as used herein refers to apparent viscosity. Apparent viscosity may be measured according to the American Petroleum Institute's API RP 10B-2 ($2^{nd}$ Edition, Apr. 1, 2013) procedure. Once exposed to the magnetic field, the magnetorheological fluid 152 is transformed to a viscoelastic solid and is placed in a viscosified state and has a second viscosity when contained in and forming the base plug 150. The second viscosity is at least 100 times greater than the first viscosity, or about 200, about 300, about 500, about 700, or about 1,000 times greater than the first viscosity, or even greater. In some embodiments, the ratio of the first viscosity to the second viscosity ranges from about 1:1 to about 1:1,000, from about 1:1 to about 1:700, from about 1:1 to about 1:500, from about 1:1 to about 1:300, from about 1:1 to about 1:200, from about 1:1 to about 1:100, or any ratio in between for the previously described set of ranges (i.e., a ratio of 1:50 is included in the range 1:1 to 1:100).

The magnetorheological fluid has a yield stress that is lower than the yield stress of the viscoelastic solid. The magnetorheological fluid has a yield stress ranging from 10 kPa to 100 kPa. The viscoelastic solid has a yield stress ranging from 2.5 Pa to 25 Pa.

Magnetorheological fluids are smart fluids that have the ability to change rheological behavior, such as to adjust viscosity, by several orders of magnitude under the influence of a magnetic field. The change may take place within milliseconds (e.g., less than 0.01 seconds) when placed under the influence of magnetic field. Under the influence of magnetic field, magnetic particles contained in the MR fluid polarize and form a columnar structure located parallel to the applied magnetic field. Thus, the magnetic field increases the viscosity of the MR fluid and develops additional yield stress in the structure. The viscosity change is rapid and completely reversible by ceasing or removing the magnetic field.

Typically, the MR fluid 152 is a non-colloidal suspension of micron-sized and/or nano-sized magnetic particles. The MR fluid 152 includes one or more carrier fluids, one or more types of magnetic particles, and optionally, one or more additives or other materials. The carrier fluid is a non-magnetic fluid and can be organic, aqueous, or a combination thereof. For example, the carrier fluid can be or include, but is not limited to, one or more of mineral oil, synthetic hydrocarbon oil, silicone oil, glycol, fuel oil, kerosene, diesel, water, or any combination thereof. The magnetic particles are metallic particles that are magnetic or can be magnetized when exposed to a magnetic field. The magnetic particles can be or include, but is not limited to, one or more metals, such as iron (e.g., iron powder, iron filings, iron particles), carbonyl iron, steel, magnetic stainless steel, iron-cobalt alloy, nickel, nickel alloy, cobalt, cobalt alloy, or any combination thereof. The optional additive can be or include, but is not limited to, one or more of suspension agents, thixotropic agents, anti-wear agents, anti-corrosion agents, friction modifiers, or any combination thereof. During the design of the MR fluids, the MR fluid may be compatible with the cement used for the cement plug. For example, the MR fluid may be designed so that it does not cause any issues in the cement hydration process.

In some embodiments, the MR fluid may contain about 60 to about 98 wt. % of a carrier fluid, about 2 to about 30 wt. % of magnetic particles, and about 0.1 to about 10 wt. % of an additive, all weight percentages are based on the total weight of the MR fluid. All ranges described herein include sub-ranges that fall within the disclosed endpoints of the range and specific amounts found within the endpoints of the disclosed ranges. The concentration of MR particles in the fluid may be varied depending on the desired density of the plug base, the ability to keep the MR fluid suspended for a desired duration, or a number of other potential reasons. The density of the MR fluid may range from about 8.5 lbm/gal to about 22 lbm/gal (about 1,018.52 kg/m$^3$ to about 2,636.18 kg/m$^3$) with a corresponding magnetizable particles loading ranging from 0.5 to 30% by volume, based on the total volume of the MR fluid. In some embodiments, the viscosifier is capable of suspending the magnetizable particles in the MR fluid before exposure to the magnetic field.

The selection of the type of the MR fluid can depend on the wellbore and/or environmental conditions and other fluids used in the wellbore. The selection of the type of the MR fluid can include, but is not limited to, the formation temperature, compatibility with other fluids in the wellbore or downhole environment, and particular anti-settling properties. The volume of the MR fluid that is pumped downhole is adjustable based on the lost-circulation rate at the proposed plug base location, the fluid loss into the formation, the intermixing of volumes, and the magnetic strength of the magnet and the magnetic particles in the wellbore or downhole environment.

Figure 1C:
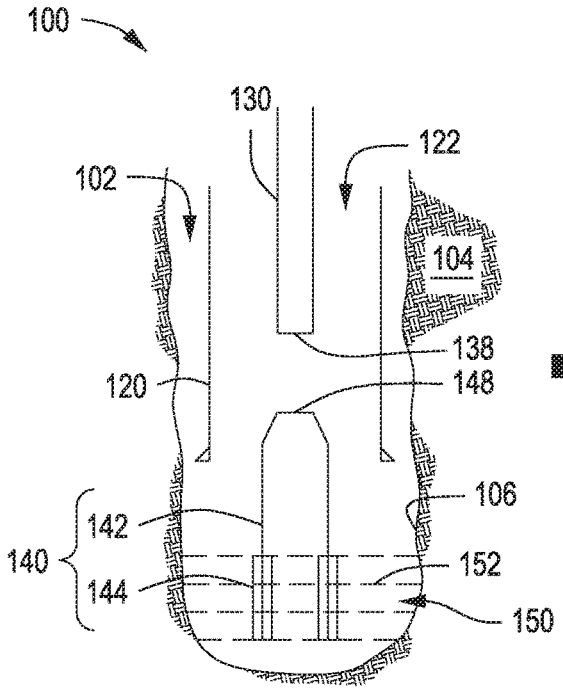

FIG. 1C depicts the detachable tool 140 disengaged or disconnected from the work string 130 after introducing the magnetorheological fluid 152 and forming the base plug 150. The detachable tool 140 hydraulically, pneumatically, mechanically, and/or electrically disengages from the work string 130. The base plug 150 holds the detachable tool 140 and the permanent magnet 144 in place within the wellbore 102. The lower surface 138 on the work string 130 is detached, decoupled, or otherwise disconnected from the upper surface 148 on the support structure 142 of the detachable tool 140. The work string 130 is depicted as moved or positioned uphole or upstream away from the detachable tool 140 after the disengagement. The work string 130 is moved in order to introduce a cement slurry without encasing the work string 130 with cement.

Subsequently, a cement slurry is introduced into the wellbore 102 and onto the base plug 150. The cement slurry can be or include one or more aqueous slurry capable of being hydrated, cured, dried, and/or hardened to produce cement, concrete, or calcium silicate matrix. The cement slurry can be or include, but is not limited to, one or more cement, calcium oxides, silicates, lime, calcium silicates, plaster, mortar, sand, gravel, binders, fillers, or any combination thereof. In some embodiments, the cement slurry includes settable components and/or fluids, resins, resin-cement composites, magnesium-based cements, and the like.

Figure 1D:
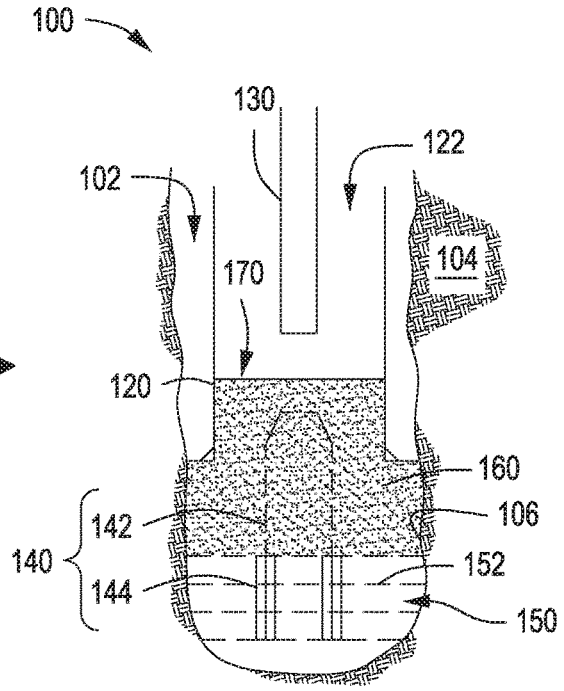

As depicted in FIG. 1D, a downhole plug 170 is formed after the cement slurry is hydrated, cured, dried, or hardened, which forms a cement plug 160 located on the base plug 150. The base plug 150 is in contact with the surface 106 about the perimeter of the wellbore 122. The base plug 150 is held into place and supports the weight of the cement slurry and later the cement plug 160. As such, the cement plug 160 is formed on the base plug 150 without slumping. In one or more embodiments, the base plug 150 is produced inside of the wellbore 102 but outside of the casing 120 downhole from the casing 120 while the cement plug 160 is produced at least partially inside and outside of the casing 120. Besides containing the base plug 150 and the cement plug 160, the downhole plug 170 may also include the detachable tool 140 and the permanent magnet 144. The base plug 150 contains the magnetorheological fluid 152 in a viscosified or gelled state, the cement plug 160 contains the cured concrete, and the detachable tool 140 is contained in at least the base plug 150 and the cement plug 160. In some embodiments, the cement plug may contain various reactive stages resulting from the crude cement slurry including but not limited to crude concrete slurry mixture, plastic concrete, uncured concrete, cured concrete, etc.

In one or more embodiments, a method for producing the downhole plug in the wellbore 102 includes positioning the permanent magnet 144 in the wellbore 102, introducing the magnetorheological fluid 152 having a first viscosity into the wellbore 102, and exposing the magnetorheological fluid 152 to a magnetic field generated by the permanent magnet 144 to produce the base plug 150 within the wellbore 102. The base plug 150 contains the viscoelastic solid derived from the magnetorheological fluid 152 and has a second viscosity that is greater than the first viscosity of the magnetorheological fluid. The method also includes introducing a cement slurry into the wellbore 102 and onto the base plug 150 and curing the cement slurry to produce a cement plug 160 on the base plug 150.

Figure 2:
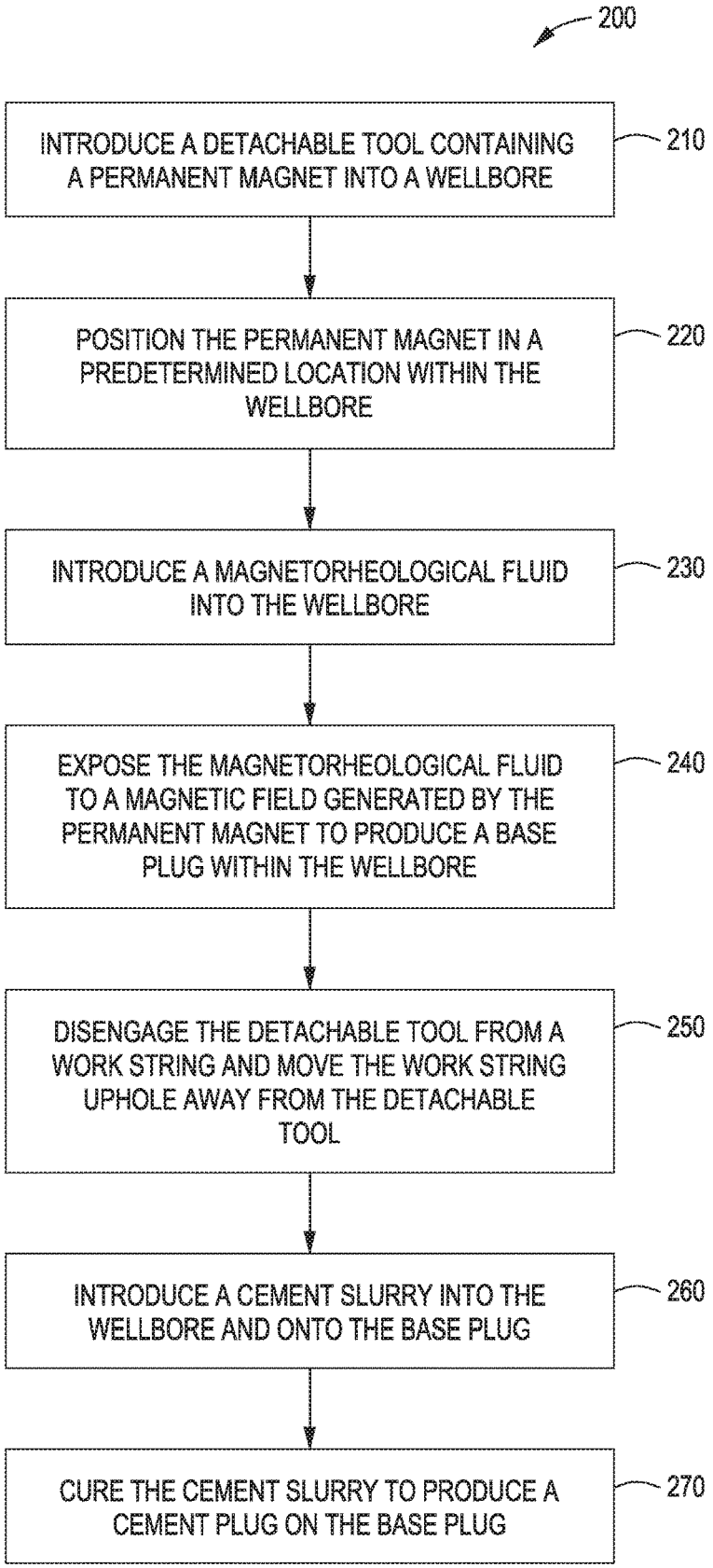
FIG. 2 is a flow chart depicting a method for producing a downhole plug within a wellbore, according to one or more embodiments.

FIG. 2 is a flow chart depicting a method 200 for producing a downhole plug within the well system. The wellbore can include a casing extending into the wellbore from the ground surface.

At 210, a detachable tool is introduced or placed into a wellbore. The detachable tool includes one or more permanent magnets coupled to a support structure. The detachable tool is coupled to a work string that is used to position and move the detachable tool within the wellbore.

At 220, the permanent magnet is positioned in a desired location within the wellbore via the work string.

At 230, a MR fluid is introduced or placed into the wellbore via the work string and/or the annulus of the casing. The MR fluid can be pumped downhole from the ground surface.

At 240, as the MR fluid passes into the wellbore, the MR fluid is exposed to a magnetic field generated by the permanent magnet. The magnetic field increases the viscosity of the MR fluid by several magnitudes as to produce a base plug that contains a viscoelastic solid derived from the magnetorheological fluid within the wellbore. As the MR fluid is pumped downhole and the viscosity of the MR fluid increases, subsequently, the pressure to pump the MR fluid further increases. The increase of pressure is a signal that the MR fluid has formed a stable base plug. The location of the detachable tool and the permanent magnets is related to where the MR fluid forms a viscous base plug, such as around and adjacent to the permanent magnets.

At 250, once produced, the base plug holds in place the detachable tool and the permanent magnet. Thereafter, the detachable tool is disengaged or uncoupled from the work string. The work string is moved or positioned upstream or uphole from the detachable tool to get out of the way of the incoming cement slurry.

At 260, the cement slurry is introduced into the wellbore and onto the base plug. The base plug is held strong enough in place in the wellbore so as to support the weight of the cement slurry and later the cement plug.

At 270, the cement slurry is cured or dried to produce a cement plug on the base plug.

In addition to the embodiments described above, embodiments of the present disclosure further relate to one or more of the following paragraphs:

Example 1

A method for producing a plug in a wellbore within a downhole environment, comprising:

introducing a magnetorheological fluid into the wellbore;

exposing the magnetorheological fluid to a magnetic field to form a base plug within the wellbore, wherein the base plug comprises a viscoelastic solid derived from the magnetorheological fluid; and introducing a cement slurry into the wellbore and onto the base plug to form a cement plug on the base plug.

Example 2

The method of Example 1, further comprising introducing a permanent magnet into the wellbore prior to introducing the magnetorheological fluid.

Example 3

The method of Example 1 or Example 2, further comprising introducing a detachable tool comprising the permanent magnet into the wellbore.

Example 4

The method of Example 1 or any of Examples 2-3, further comprising disengaging the detachable tool from a work string after introducing the magnetorheological fluid and prior to introducing the cement slurry.

Example 5

The method of Example 1 or any of Examples 2-4, further comprising moving the work string uphole away from the detachable tool after the disengagement.

Example 6

The method of Example 1 or any of Examples 2-5, further comprising hydraulically, pneumatically, mechanically, or electrically disengaging the detachable tool from the work string.

Example 7

The method of Example 1 or any of Examples 2-6, wherein the wellbore comprises a casing extending therethrough, further comprising forming the base plug outside of the casing downhole from the casing and forming the cement plug at least partially within the casing.

Example 8

The method of Example 1 or any of Examples 2-7, wherein the magnetorheological fluid comprises a carrier fluid, magnetic particles, and an additive selected from the group consisting of suspension agent, thixotropic agent, anti-wear agent, anti-corrosion agent, friction modifier, biocide and any combination thereof.

Example 9

The method of Example 1 or any of Examples 2-8, wherein the carrier fluid comprises mineral oil, synthetic hydrocarbon oil, silicone oil, glycol, and any combination thereof, and wherein the magnetic particles comprise iron, carbonyl iron, magnetic stainless steel, nickel, nickel alloy, cobalt, cobalt alloy, iron-cobalt alloy, and any combination thereof.

Example 10

The method of Example 1 or any of Examples 2-9, wherein the magnetorheological fluid is introduced into the wellbore having a first viscosity, and wherein the viscoelastic solid derived from the magnetorheological fluid has a second viscosity at least 100 times greater than the first viscosity.

Example 11

A method for producing a plug in a wellbore within a downhole environment, comprising:

positioning a permanent magnet in the wellbore;

introducing a magnetorheological fluid having a first viscosity into the wellbore;

exposing the magnetorheological fluid to a magnetic field downhole generated by the permanent magnet, wherein a viscoelastic solid derived from the magnetorheological fluid is produced, wherein the viscoelastic solid has a second viscosity greater than the first viscosity;

introducing a cement slurry into the wellbore and onto the base plug; and forming a cement plug on the base plug from the cement slurry.

Example 12

The method of Example 11, further comprising introducing a detachable tool comprising the permanent magnet into the wellbore.

Example 13

The method of Example 11 or Example 12, further comprising disengaging the detachable tool from a work string after introducing the magnetorheological fluid and prior to introducing the cement slurry.

Example 14

The method of Example 11 or any of Examples 12-13, further comprising moving the work string uphole away from the detachable tool after the disengagement.

Example 15

The method of Example 11 or any of Examples 12-14, further comprising hydraulically, pneumatically, mechanically, or electrically disengaging the detachable tool from the work string.

Example 16

The method of Example 11 or any of Examples 12-15, wherein the wellbore comprises a casing extending therethrough, wherein the base plug is formed outside of the casing downhole from the casing, and wherein the cement plug is formed at least partially within the casing.

Example 17

The method of Example 11 or any of Examples 12-16, wherein the magnetorheological fluid comprises a carrier fluid, magnetic particles, and an additive selected from the group consisting of suspension agent, thixotropic agent, anti-wear agent, anti-corrosion agent, friction modifier, biocide and any combination thereof.

Example 18

The method of Example 11 or any of Examples 12-17, wherein the carrier fluid comprises mineral oil, synthetic hydrocarbon oil, silicone oil, glycol, and any combination thereof, and wherein the magnetic particles comprise iron, carbonyl iron, magnetic stainless steel, iron-cobalt alloy, nickel alloy, and any combination thereof.

Example 19

The method of Example 11 or any of Examples 12-18, wherein the second viscosity is at least 100 times greater than the first viscosity.

Example 20

A downhole plug, comprising:

a base plug comprising a permanent magnet and a viscoelastic solid derived from a magnetorheological fluid;

a cement plug positioned on the base plug; and a detachable tool contained in at least the base plug and the cement plug, wherein the permanent magnet is coupled to the detachable tool.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

One or more specific embodiments of the present disclosure have been described. In an effort to provide a concise description of these embodiments, all features of an actual implementation may not be described in the specification. Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method for producing a plug in a wellbore within a downhole environment, comprising:

introducing a magnetorheological fluid into the wellbore and extending across a diameter of the wellbore;

exposing the magnetorheological fluid to a magnetic field to form a base plug within the wellbore, wherein the base plug comprises a viscoelastic solid derived from the magnetorheological fluid extending across the diameter of the wellbore; and introducing a cement slurry into the wellbore and onto the base plug to form a cement plug on the base plug.

2. The method of claim 1, further comprising introducing a permanent magnet into the wellbore prior to introducing the magnetorheological fluid.

3. The method of claim 2, further comprising introducing a detachable tool comprising the permanent magnet into the wellbore.

4. The method of claim 3, further comprising disengaging the detachable tool from a work string after introducing the magnetorheological fluid and prior to introducing the cement slurry.

5. The method of claim 4, further comprising moving the work string uphole away from the detachable tool after the disengagement.

6. The method of claim 4, further comprising hydraulically, pneumatically, mechanically, or electrically disengaging the detachable tool from the work string.

7. The method of claim 1, wherein the wellbore comprises a casing extending therethrough, further comprising forming the base plug outside of the casing downhole from the casing and forming the cement plug at least partially within the casing.

8. The method of claim 1, wherein the magnetorheological fluid comprises a carrier fluid, magnetic particles, and an additive selected from the group consisting of suspension agent, thixotropic agent, anti-wear agent, anti-corrosion agent, friction modifier, biocide and any combination thereof.

9. The method of claim 8, wherein the carrier fluid comprises mineral oil, synthetic hydrocarbon oil, silicone oil, glycol, and any combination thereof, and wherein the magnetic particles comprise iron, carbonyl iron, magnetic stainless steel, nickel, nickel alloy, cobalt, cobalt alloy, iron-cobalt alloy, and any combination thereof.

10. The method of claim 1, wherein the magnetorheological fluid is introduced into the wellbore having a first viscosity, and wherein the viscoelastic solid derived from the magnetorheological fluid has a second viscosity at least 100 times greater than the first viscosity.

11. A method for producing a plug in a wellbore within a downhole environment, comprising:

positioning a permanent magnet in the wellbore;

introducing a magnetorheological fluid having a first viscosity into the wellbore;

exposing the magnetorheological fluid to a magnetic field downhole generated by the permanent magnet, wherein a base plug comprising a viscoelastic solid derived from the magnetorheological fluid is produced that extends across a diameter of the wellbore, wherein the viscoelastic solid has a second viscosity greater than the first viscosity;

introducing a cement slurry into the wellbore and onto the base plug; and forming a cement plug on the base plug from the cement slurry.

12. The method of claim 11, further comprising introducing a detachable tool comprising the permanent magnet into the wellbore.

13. The method of claim 12, further comprising disengaging the detachable tool from a work string after introducing the magnetorheological fluid and prior to introducing the cement slurry.

14. The method of claim 13, further comprising moving the work string uphole away from the detachable tool after the disengagement.

15. The method of claim 13, further comprising hydraulically, pneumatically, mechanically, or electrically disengaging the detachable tool from the work string.

16. The method of claim 11, wherein the wellbore comprises a casing extending therethrough, wherein the base plug is formed outside of the casing downhole from the casing, and wherein the cement plug is formed at least partially within the casing.

17. The method of claim 11, wherein the magnetorheological fluid comprises a carrier fluid, magnetic particles, and an additive selected from the group consisting of suspension agent, thixotropic agent, anti-wear agent, anti-corrosion agent, friction modifier, biocide and any combination thereof.

18. The method of claim 17, wherein the carrier fluid comprises mineral oil, synthetic hydrocarbon oil, silicone oil, glycol, and any combination thereof, and wherein the magnetic particles comprise iron, carbonyl iron, magnetic stainless steel, iron-cobalt alloy, nickel alloy, and any combination thereof.

19. The method of claim 11, wherein the second viscosity is at least 100 times greater than the first viscosity.

20. A downhole plug for plugging a wellbore within a downhole environment, comprising:

a base plug comprising a permanent magnet and a viscoelastic solid derived from a magnetorheological fluid and extending across a diameter of the wellbore;

a cement plug positioned on the base plug;

a detachable tool contained in at least the base plug and the cement plug; and wherein the permanent magnet is coupled to the detachable tool.

* * * * *